United States Patent [19]

Schmidlin

[11] Patent Number: 4,580,948

[45] Date of Patent: Apr. 8, 1986

[54] HYDROKINETIC AMPLIFIER WITH HIGH MOMENTUM TRANSFER COEFFICIENT

[75] Inventor: Frederick W. Schmidlin, Pittsford, N.Y.

[73] Assignee: Helios Research Corp., Mumford, N.Y.

[21] Appl. No.: 632,245

[22] Filed: Jul. 19, 1984

[51] Int. Cl.[4] ..... F04F 5/46

[52] U.S. Cl. ..... 417/54; 417/151; 417/179; 417/180; 417/187; 417/196; 417/197; 417/198

[58] Field of Search ..... 417/54, 151, 176–180, 417/187, 196–198

[56] References Cited

U.S. PATENT DOCUMENTS

| | | | |
|---|---|---|---|
| 697,770 | 4/1902 | Allen | 417/192 |
| 749,050 | 1/1904 | Fraser | 417/179 |
| 944,455 | 12/1909 | Metcalfe et al. | 417/196 X |
| 1,015,822 | 1/1912 | Mueller | 417/179 X |
| 1,328,139 | 1/1920 | Elliott, Jr. | 417/54 |
| 1,421,840 | 7/1922 | Schmidt | 417/177 |
| 1,447,103 | 2/1923 | Schmidt | 417/196 |
| 1,449,504 | 3/1923 | Ehrhart | 417/54 |
| 1,568,466 | 1/1926 | Ostermann | 417/187 |
| 2,046,887 | 7/1936 | Walch | 417/192 X |
| 3,719,524 | 3/1973 | Ripley et al. | 417/180 |
| 4,379,679 | 4/1983 | Guile | 417/179 X |

*Primary Examiner*—William L. Freeh
*Assistant Examiner*—Paul F. Neils
*Attorney, Agent, or Firm*—Stonebraker, Shepard & Stephens

[57] ABSTRACT

A hydrokinetic amplifier 10 increases the vapor momentum transfer coefficient by directing an annular liquid jet 20 into an acceleration chamber 13 and impinging high velocity vapor streams on both the interior and exterior surfaces of annular liquid jet 20. Impinging merger of the inner vapor stream on the inner surface of liquid jet 20 transfers all the vapor momentum to the liquid. The outer vapor stream surrounding annular liquid jet 20 helps keep liquid out of contact with the acceleration chamber wall 19 and otherwise transfers a substantial portion of its vapor momentum to the liquid on which it impinges and condenses. Multiple annular liquid nozzles 11*a* and 11*b* and corresponding multiple vapor nozzles 50*a* and 50*b* can be arranged concentrically to capture all the momentum of the inner vapor streams, leaving only the outermost vapor stream to experience friction losses along the acceleration chamber wall 19.

20 Claims, 2 Drawing Figures

HYDROKINETIC AMPLIFIER WITH HIGH MOMENTUM TRANSFER COEFFICIENT

BACKGROUND

Hydrokinetic amplifiers, such as explained in U.S. patent application Ser. No. 612,742, filed May 21, 1984, entitled HYDROKINETIC AMPLIFIER, far surpass injectors in their ability to transfer momentum from vapor to liquid for increasing the liquid pressure. Momentum transfer coefficients for injectors have ranged up to about 0.5, and hydrokinetic amplifiers have increased this coefficient to more than 0.6, thereby more than doubling the pressure gain achieved by injectors.

I have discovered a way that hydrokinetic amplifiers can further increase the coefficient of momentum transfer to at least 0.8. This makes hydrokinetic amplifiers operate even more efficiently and achieve an even higher pressure gain between liquid input and output. It also expands the potential uses for hydrokinetic amplifiers.

SUMMARY OF THE INVENTION

I have discovered that vapor accelerated to a high velocity can transfer more momentum to a liquid jet by impinging on both the inner and outer surfaces of an annular liquid jet entering the acceleration chamber of a hydrokinetic amplifier. By keeping the liquid away from the acceleration chamber wall and balancing the liquid and vapor flows, the liquid jet can be made to converge from annular to cylindrical as it accelerates toward the diffuser. As the liquid jet converges, it captures all the momentum of a high velocity vapor stream entering the annular interior of the liquid jet, while the liquid also receives substantial momentum from an outer vapor stream that helps keep the liquid clear of the acceleration chamber wall. Accelerating both vapor streams to supersonic velocity can raise vapor momentum to a high value, and impinging both the inner and outer vapor streams against the liquid jet can transfer at least 80% of the vapor momentum to the liquid, accelerating the liquid to a high velocity producing a high liquid pressure gain.

Two or more annular liquid jets with different diameters can be arranged concentrically with high velocity vapor streams directed both within and around each annular liquid jet. Multiple liquid jets can converge and merge to a single liquid stream as they pass through the acceleration chamber, converting to liquid velocity all the momentum of the vapor streams within the liquid jets and subjecting only the outermost vapor stream to some friction loss along the converging wall of the acceleration chamber. The flow rates of the liquid and vapor streams can be adjusted to ensure maximum condensation, maximum momentum transfer, and complete liquid merger upon reaching the diffuser, which efficiently converts liquid velocity to pressure.

DRAWINGS

FIG. 1 is a schematic view of a preferred embodiment of a hydrokinetic amplifier having a high momentum transfer coefficient; and FIG. 2 is a schematic view of a multi-liquid jet embodiment of a hydrokinetic amplifier having a high momentum transfer coefficient.

DETAILED DESCRIPTION

Figure 1:
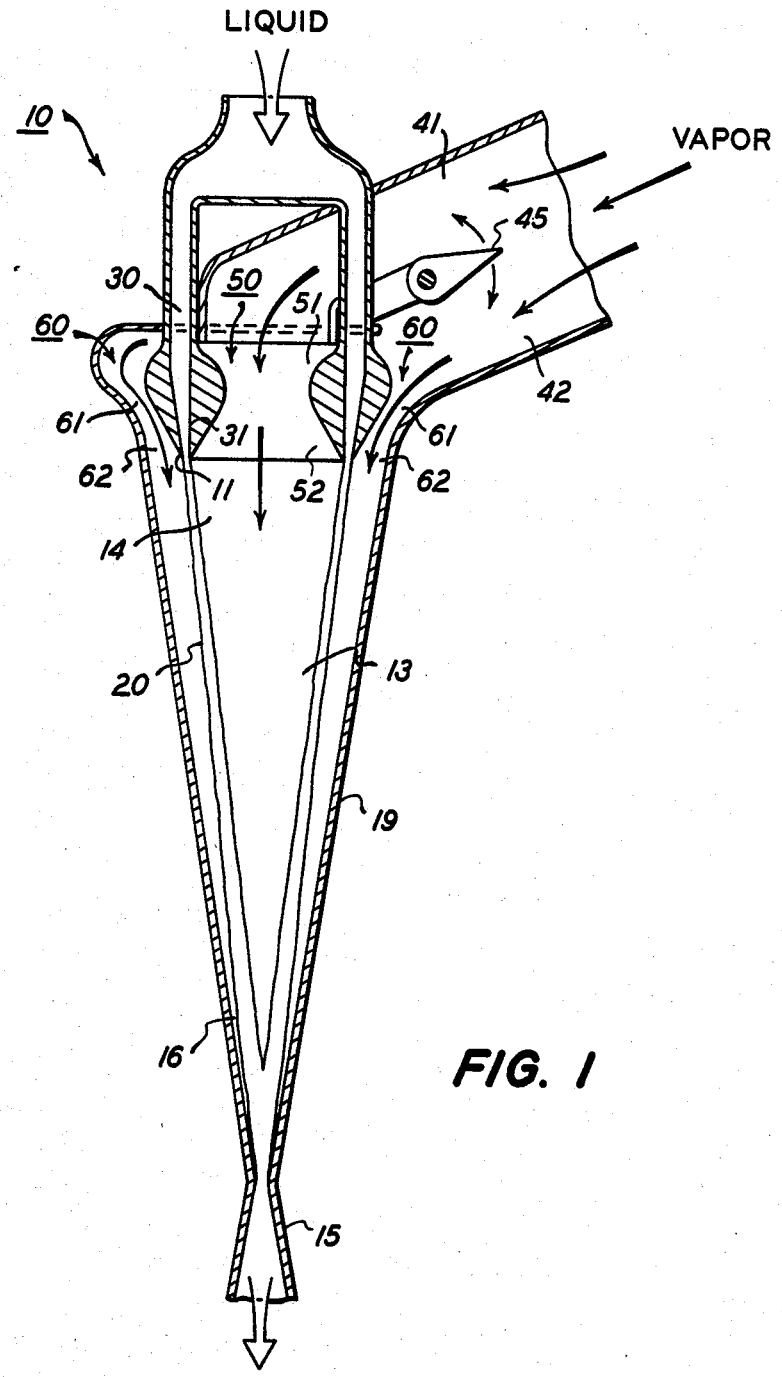

Hydrokinetic amplifier 10, as schematically shown in FIG. 1, includes an acceleration chamber 13 having an outer wall 19 converging from an ingress region 14 to an egress region 16, downstream from which a diffuser 15 extends. Vapor accelerates liquid through acceleration chamber 13 as described in U.S. patent application Ser. No. 612,742 for hydrokinetic amplifiers in general, from which hydrokinetic amplifier 10 differs primarily in liquid and vapor inputs.

Liquid inbound to amplifier 10 enters an annular path 30 leading to a converging region 31 of an annular liquid input nozzle 11. Liquid nozzle 11 efficiently converts liquid pressure to velocity and discharges an annular liquid jet 20 into ingress region 14 of acceleration chamber 13. Liquid nozzle 11 is also spaced inward from converging wall 19 of acceleration chamber 13 so that liquid in jet 20 remains out of contact with wall 19 while it accelerates from ingress region 14 to egress region 16.

Vapor inbound to amplifier 10 is either drawn from two different vapor sources or divided from a single source into two flows along an inner vapor path 41 and an outer vapor path 42 as schematically illustrated. Inner path 41 leads to the interior of annular liquid path 30 and to an inner vapor nozzle 50, and outer path 42 leads to an outer vapor nozzle 60 annularly surrounding liquid nozzle 11.

Vapor nozzle 50 has a throat region 51 providing a minimum cross-sectional area arranged upstream from the discharge region of liquid nozzle 11. Downstream from throat region 51, vapor nozzle 50 has an expanding region 52 of increasing cross-sectional area through which vapor accelerates into ingress region 14.

Incoming vapor preferably reaches sonic velocity in throat region 51 and supersonic velocity in expansion region 52, and vapor nozzle 50 preferably produces maximum vapor thrust so that vapor from inner nozzle 50 is traveling as fast as possible when it impinges on the inside surface of annual liquid jet 20. As this occurs, substantially all of the momentum of the speeding vapor transfers to the liquid in jet 20, causing it to accelerate toward egress region 16. Vapor condensing in the liquid also collapses, reducing the vapor volume to make room for more vapor speeding into and impinging on the diminishing cone of the inner surface of liquid jet 20.

Vapor in outer path 42 flows through an annular outer vapor nozzle 60, which also has a throat region 61 with a minimum cross-sectional area and an expanding region 62 with an enlarging cross-sectional area leading to a discharge at ingress region 14. Outer vapor nozzle 16 also is preferably designed for maximum thrust so that vapor can accelerate from sonic velocity in throat region 61 to supersonic velocity in expansion region 62 before merging with liquid in jet 20 at ingress region 14.

The outer vapor stream from annular nozzle 60 surrounds annular liquid jet 20 and flows between jet 20 and the converging wall 19 of acceleration chamber 13. In this location, the outer vapor stream not only impinges on and accelerates the liquid in jet 20, but also helps keep liquid out of contact with acceleration chamber wall 19 so as to minimize fluid friction losses.

Flow rates through vapor nozzles 50 and 60 are preferably adjustable so that liquid jet 20 can receive and condense vapor at the fastest rate possible from both the inner and outer vapor streams without blowing apart or running into contact with acceleration chamber wall 19.

Adjusting or balancing flow rates through vapor nozzles 50 and 60 and liquid nozzle 11 can make annular liquid jet 20 converge in a generally conical flow and merge to a solid liquid stream as it enters egress region 16. The many possible ways available in the art of regulating vapor flow rates are schematically illustrated by vapor valve 45.

Substantially all of the vapor from inner nozzle 11 and at least about 90% of the total inflowing vapor condenses in and accelerates the liquid stream 20 before the fluid flow passes into diffuser 15. The minimum cross-sectional area of diffuser 15 at egress region 16 is dimensioned to be up to about 10% larger than the cross-sectional area of the through-flowing liquid.

Figure 2:
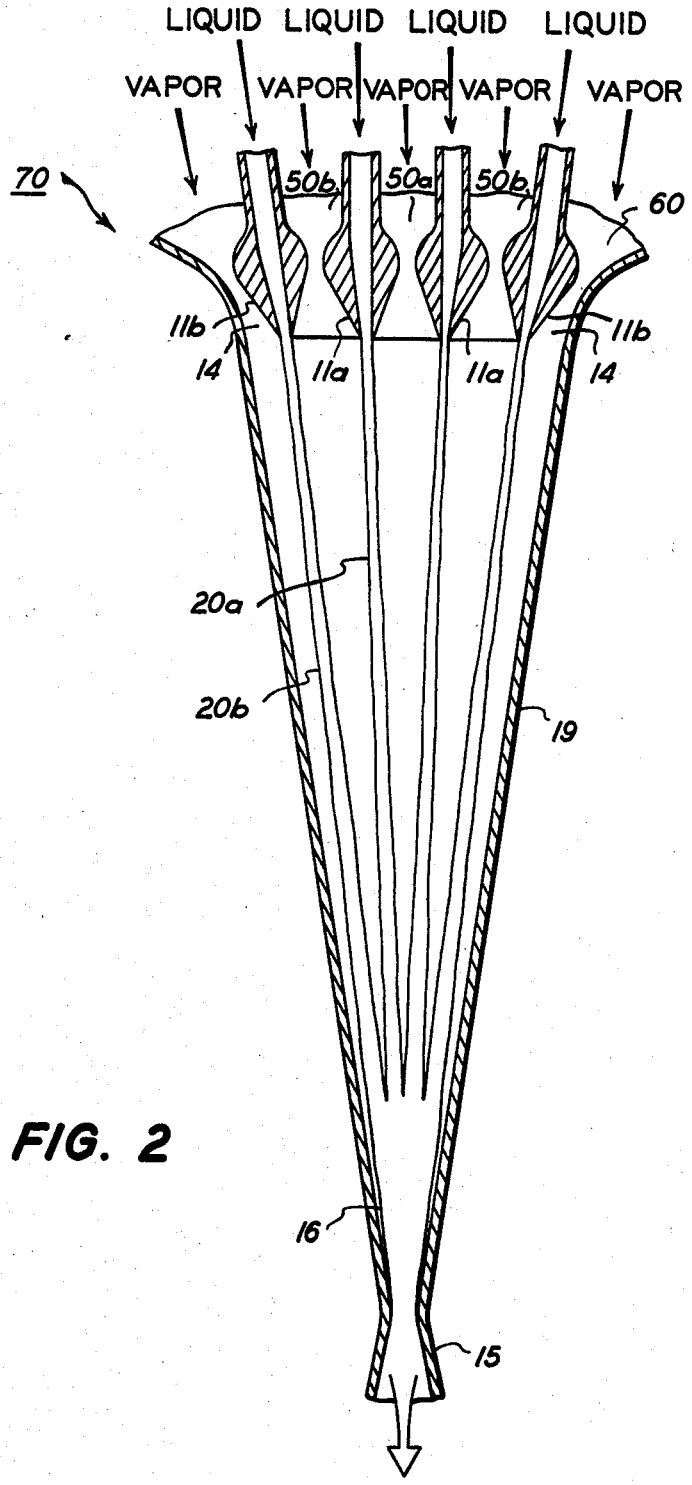

Hydrokinetic amplifier 70 of FIG. 2 schematically shows to annular and concentric liquid jets 20*a* and 20*b*. These are discharged from concentric annular liquid nozzles 11*a* and 11*b* and receive high velocity vapor from respective inner vapor nozzles 50*a* and 50*b* and outer vapor nozzle 60 surrounding outer liquid nozzle 11*b*. Such an arrangement captures all the momentum of the expanding vapor from inner nozzles 50*a* and 50*b*, along with a substantial portion of the momentum of the vapor from outer vapor nozzle 60.

More than two concentric annular liquid jets can also be used for capturing the momentum of multiple interior vapor streams. Only the exterior vapor stream around the outermost liquid jet experiences friction losses along acceleration chamber wall 19.

I claim:

1. A hydrokinetic amplifier configured to receive liquid and vapor for condensing said vapor in said liquid, transferring momentum from said vapor to said liquid, and increasing the pressure of said liquid substantially from input to output, said hydrokinetic amplifier comprising:

a. an acceleration chamber having an ingress region and an egress region;

b. a wall of said acceleration chamber gradually converging from said ingress region toward said egress region;

c. a diffuser extending downstream from said egress region;

d. an inner vapor nozzle having a throat region arranged upstream of said ingress region and an expanding region arranged downstream from said throat region;

e. said inner vapor nozzle being arranged to discharge expanding vapor directed into said ingress region to flow toward said egress region;

f. an annular liquid nozzle surrounding said inner vapor nozzle and spaced inward from said acceleration chamber wall;

g. said liquid nozzle being arranged for discharging an annular liquid jet directed into said ingress region to surround and contact said expanding vapor at the discharge region of said inner vapor nozzle and to be spaced from said acceleration chamber wall throughout an acceleration path from said discharge region of said liquid and vapor nozzles to said egress region;

h. an annular outer vapor nozzle surrounding said liquid nozzle;

i. said outer vapor nozzle having a throat region arranged upstream of said discharge region of said liquid nozzle and an expanding region arranged downstream from said throat region;

j. said outer vapor nozzle being arranged for discharging expanding vapor directed into said ingress region to surround and contact said annular liquid jet at said discharge region of said liquid nozzle and flow toward said egress region within an annular space between said liquid jet and said wall of said acceleration chamber; and k. said inner and outer vapor nozzles, said liquid nozzle, and said acceleration chamber being arranged so that said annular liquid jet converges to a cylindrical liquid jet while condensing and receiving substantially all of the momentum of said expanding vapor from said inner vapor nozzle and while condensing and receiving a substantial portion of the momentum of said extending vapor from said outer vapor nozzle, whereby the coefficient of momentum transfer from expanding vapor to liquid is at least 0.8.

2. The hydrokinetic amplifier of claim 1 wherein said inner and outer vapor nozzles are each shaped to maximize thrust.

3. The hydrokinetic amplifier of claim 1 wherein said inner and outer vapor nozzles and said acceleration chamber are arranged so that said vapor reaches sonic velocity in said throat regions of said vapor nozzles and supersonic velocity in said expanding regions of said vapor nozzles.

4. The hydrokinetic amplifier of claim 1 wherein said liquid and vapor input nozzles and said acceleration chamber are arranged so that at least about 90% of said vapor condenses in said liquid jet before reaching said egress region.

5. The hydrokinetic amplifier of claim 1 wherein said minimum cross-sectional area of said egress region is less than the cross-sectional area of said discharge region of said liquid input nozzle.

6. The hydrokinetic amplifier of claim 5 wherein said inner and outer vapor nozzles and said acceleration chamber are arranged so that said vapor reaches sonic velocity in said throat regions of said vapor nozzles and supersonic velocity in said expanding regions of said vapor nozzles.

7. The hydrokinetic amplifier of claim 6 wherein said inner and outer vapor nozzles are each shaped to maximize thrust.

8. The hydrokinetic amplifier of claim 1 wherein the cross-sectional area of said egress region is up to about 10% larger than the cross-sectional area of the liquid stream passing through said egress region.

9. The hydrokinetic amplifier of claim 8 wherein said liquid and vapor input nozzles and said acceleration chamber are arranged so that at least about 90% of said vapor condenses in said liquid jet before reaching said egress region.

10. The hydrokinetic amplifier of claim 9 wherein said inner and outer vapor nozzles and said acceleration chamber are arranged so that said vapor reaches sonic velocity in said throat regions of said vapor nozzles and supersonic velocity in said expanding regions of said vapor nozzles.

11. The hydrokinetic amplifier of claim 10 wherein said inner and outer vapor nozzles are each shaped to maximize thrust.

12. The hydrokinetic amplifier of claim 1 including a plurality of said liquid nozzles arranged to form a plurality of said annular liquid jets aimed to converge with each other to form said cylindrical liquid jet, and a corresponding plurality of said inner and outer vapor nozzles arranged within and around each of said annular liquid jets.

13. The hydrokinetic amplifier of claim 12 wherein said inner and outer vapor nozzles and said acceleration chamber are arranged so that said vapor reaches sonic velocity in said throat regions of said vapor nozzles and supersonic velocity in said expanding regions of said vapor nozzles.

14. The hydrokinetic amplifier of claim 13 wherein said minimum cross-sectional area of said egress region is less than the total cross-sectional areas of said discharge regions of said liquid input nozzles.

15. The hydrokinetic amplifier of claim 13 wherein said liquid and vapor input nozzles and said acceleration chamber are arranged so that at least about 90% of said vapor condenses in said liquid jet before reaching said egress region.

16. The hydrokinetic amplifier of claim 15 wherein said inner and outer vapor nozzles are each shaped to maximize thrust.

17. A method of operating a hydrokinetic amplifier to achieve a coefficient of momentum transfer from vapor to liquid of at least 0.8, said method comprising:

a. directing an inner stream of expanding vapor into an acceleration chamber of said hydrokinetic amplifier;

b. directing an annular liquid jet into said acceleration chamber to surround said inner vapor stream;

c. directing an outer stream of expanding vapor into said acceleration chamber to surround said annular liquid jet;

d. flowing said inner and outer vapor streams and said annular liquid jet in the same direction along a converging path; and e. setting the flow rates of said inner and outer vapor streams so that said liquid jet accelerates and converges from annular to cylindrical while condensing and receiving substantially all of the momentum of said inner vapor stream and while condensing and receiving a substantial portion of the momentum of said outer vapor stream, said liquid jet staying clear of any wall while accelerating along said converging path.

18. The method of claim 17 including accelerating said inner and outer vapor streams to supersonic velocity.

19. The method of claim 17 including directing a plurality of said annular liquid jets into said acceleration chamber to converge with each other and directing a corresponding plurality of said inner and outer vapor streams into said acceleration chamber within and around each of said annular liquid jets.

20. The method of claim 19 including accelerating said inner and outer vapor streams to supersonic velocity.

* * * * *